US006098506A

United States Patent [19]

Clegg

[11] Patent Number: 6,098,506

[45] Date of Patent: Aug. 8, 2000

[54] ADJUSTABLE INCLINE WRENCH

[76] Inventor: Richard R. Clegg, 1586 Finch Way, Sunnyvale, Calif. 94087

[21] Appl. No.: 09/234,822

[22] Filed: Jan. 20, 1999

[51] Int. Cl.[7] ..... B25B 13/14

[52] U.S. Cl. ..... 81/170; 81/165; 81/177.7; 81/DIG. 5

[58] Field of Search ..... 81/170, 165, DIG. 5, 81/177.8, 177.7, 424.5, 426.5, 177.9

[56] References Cited

U.S. PATENT DOCUMENTS

| | | | |
|---|---|---|---|
| 1,080,121 | 12/1913 | Oriol | 81/177.7 X |
| 1,493,741 | 5/1924 | Ellison | 81/170 |
| 2,722,150 | 11/1955 | Green | 81/165 |
| 4,326,436 | 4/1982 | McGraw | 81/DIG. 3 X |
| 5,305,667 | 4/1994 | Caballero | 81/117.4 X |

*Primary Examiner*—D. S. Meislin
*Attorney, Agent, or Firm*—Robert & Samuel Smith

[57] ABSTRACT

An adjustable wrench having a handle with two handle sections himgeably joined end to end with a jaw section mounted on one free end of one section. A clip is provided for locking orientation of the two sections with respect to one another for turning fasteners that are located in awkwardly accessible locations. Indicia on the jaws of the wrench indicate spacing of the jaws for standard sizes. The gripping surfaces of the moveable jaw has an area that is parallel to an area of the fixed jaw for quick accessibility of the wrench. The gripping surfaces of the fixed and moveable jaws also have areas that are contoured to present broad areas of contact to either a hexagonal fastener or a square fastener.

5 Claims, 3 Drawing Sheets

ADJUSTABLE INCLINE WRENCH

FIELD OF THE INVENTION

This invention relates to wrenches and particularly to a wrench with adjustable contoured jaws and having a handle comprising two sections hinged together such as to permit selection of the angle of the handle with the axis of turning of the fastener.

PRIOR ART AND INFORMATION DISCLOSURE

A wrench is an elongated lever with means for securing one end to an object so that force applied to the other end of the lever exerts a torque to overcome resistance to rotating the object. In one application, the function is to tighten tighten or loosen a bolt in a threaded hole by engaging the wrench with the head of the bolt. In another application, the function is to tighten a nut onto a bolt. A popular wrench for these purposes is the so-called crescent wrench where the means for securing is simply a pair of fixed jaws spaced parallel to one another such that the jaws conformingly straddle the head or nut. Such wrenches are available in various sizes, each size selected for a particular size bolt so that the typical mechanics toolbox will have a "nest" of such (non adjustable) wrenches.

In order to avoid the requirement for a nest of wrenches to accommodate a range of sizes of bolts, so-called "adjustable" wrenches are available in which the distance between the parallel jaws is adjustable by simply turning a worm gear mounted in the handle of the wrench.

The problem with open ended crescent wrenches and with adjustable wrenches having parallel jaws is that the area of contact of the jaws with the nut or bolt head is so small that, if sufficient torque is applied by the wrench, the wrench slips around the bolt and strips the nut or bolt head.

To prevent stripping the head of the bolt, "box" wrenches are available in which the jaws of the wrench is an enclosure that fits entirely around in contact with the nut or bolt head. Since some nuts or bolt heads are square and others are hexagonal for each of the standard sizes of bolts, the number of box wrenches that must be available is large. Although box wrenches are useful where strong purchase to the nut or bolt head is required, they are generally more awkward to use than the open end wrench so that some wrenches are provided with an open crescent jaw configuration on one end and a box configuration on the other end.

Wrenches have been disclosed which are attempts to combine the advantages of the box wrench (which provides a secure purchase) and the adjustable crescent wrench. (which is intended to fit a range of sizes.

For example, U.S. Pat. No. 5,595,098 to Malkin discloses having contoured opposing jaws for fully engaging hexagonaly shaped fasteners including a two-surfaced jaw and an opposingly disposed three surfaced jaw.

U.S. Pat. No. 1,490,903 to Anderson discloses an adjustable wrench with flat jaws but each having a notch to permit grips being taken either on the flat or the corner of a nut as desired.

U.S. Pat. No. 3,955,450 to Evans discloses an adjustable wrench wherein, in one embodiment, the jaws are configured to engage a hexagon nut, in a second configuration, the jaws are configured to engage a square nut. The selection of the jaw contour depends on the shape of the nut.

In order to understand that the wrenches of the prior art do not provide the advantages and conveniences of the present invention, it is useful to understand the procedure that the mechanic follows in applying the wrench. If his wrenches are fixed jaw, he must search through his nest to fine the wrench that is the right size for the job. This inconvenience persuades him to use an adjustable wrench. He positions the wrench with the nut between the jaws and then turns a worm screw on the handle of the wrench which causes the jaws to close on top flat sides of the nut. Closing of the jaws must be done with care or, otherwise, the opening left between the jaws is large enough so that wrench slips on the nut when appreciable torque is applied to the wrench and may strip the nut. If the jaws are sufficiently tight on the nut, then, after each turn of the wrench, the jaws must be loosened to disengage the wrench from the nut and repositioned for the next turn. For wrenches of the Malin design, the wrench is placed down over the nut. The consequence is that several readjustments of the jaws must be made in removing or tightening the nut.

With each adjustment, the procedure is a trial an error procedure where the jaws may be too close or too distal to either fit the nut or prevent slippage. If the jaws have a simple notch (as in Anderson, then the jaws of the wrench cannot fully accommodate both a square nut and a hexagonal nut.

Another inconvenience is encountered in using a box wrench or wrench with conforming jaws such as described in the prior art. I such situations, it is necessary to remove the wrench with each twist and then turn the wrench back to starting position and reengage the wrench. Reengagement is much easier when the wrench may be simply positioned by sliding the wench into position along the surface of the part to which the the nuts secured.

Re-engagement is particularly irksome when, after the nut or bolt has been loosened the nut must be dis-engaged and reengaged many times in order to unscrew a particularly long thread.

Another problem is encountered when an attempt is made to engage a nut that is flush with a surface in a location that is not conveniently accessible, such as under a car. When the wrench is engaged with the nut, it then is required to turn the wrench in a plane that is close to coincident with the surface. This situation often gives rise to the "knuckle busting" that is the bane of every mechanic's existence.

SUMMARY OF THE INVENTION

It is an object of this invention to provide a wrench that can be used to turn a nut having any one of a range of sizes and has a head that is either square or hexagonal shape.

It is a further object to be able to engage the wrench with the nut very tightly in order to unscrew nuts that are tight and yet be able to avoid the inconveniences of engaging/disengaging the wrench that is experienced by the wrenches of the prior art.

It is a further object to provide a wrench which is much easier and quicker to adjust to the required bolt size than is experienced with the wrenches of the prior art.

It is another object to provide a wrench where the difficulties are removed of turning a wrench in a plane coincident with the surface of entry of the bolt.

This invention is directed toward a wrench having adjustable jaws wherein the surface of each jaw has an area that will grip four surface of either a hexagonal or square nut and another area that will grip parallel surfaces of the same nut without requiring readjustment of the spacing between jaws. This feature permits a loosening operation where a tight bolt is firmly gripped by the wrench for a "bolt loosening step"

and then, without readjusting the jaw spacing, reposition the jaws so that the nut is slideably positionable between flat parallel surfaces of the jaws for quickly and repeatedly repositioning the wrench for a quick "unscrewing" operation.

The wrench is also provided with a vernier with indicia which the mechanic uses to position the jaws so that the fit of wrench on the nut is precise thereby eliminating the inconveniences a sloppy fit of the wrench over the nut.

In another embodiment, the wrench handle has two sections that are hinged together and a locks that fixes the sections at an angle with one another. A lock is provided for securing the sections in the selected position, this feature permits turning the wrench in a plane that is not parallel to surface entered by the bolt.

DESCRIPTION OF PREFERRED EMBODIMENTS.

Figure 1:
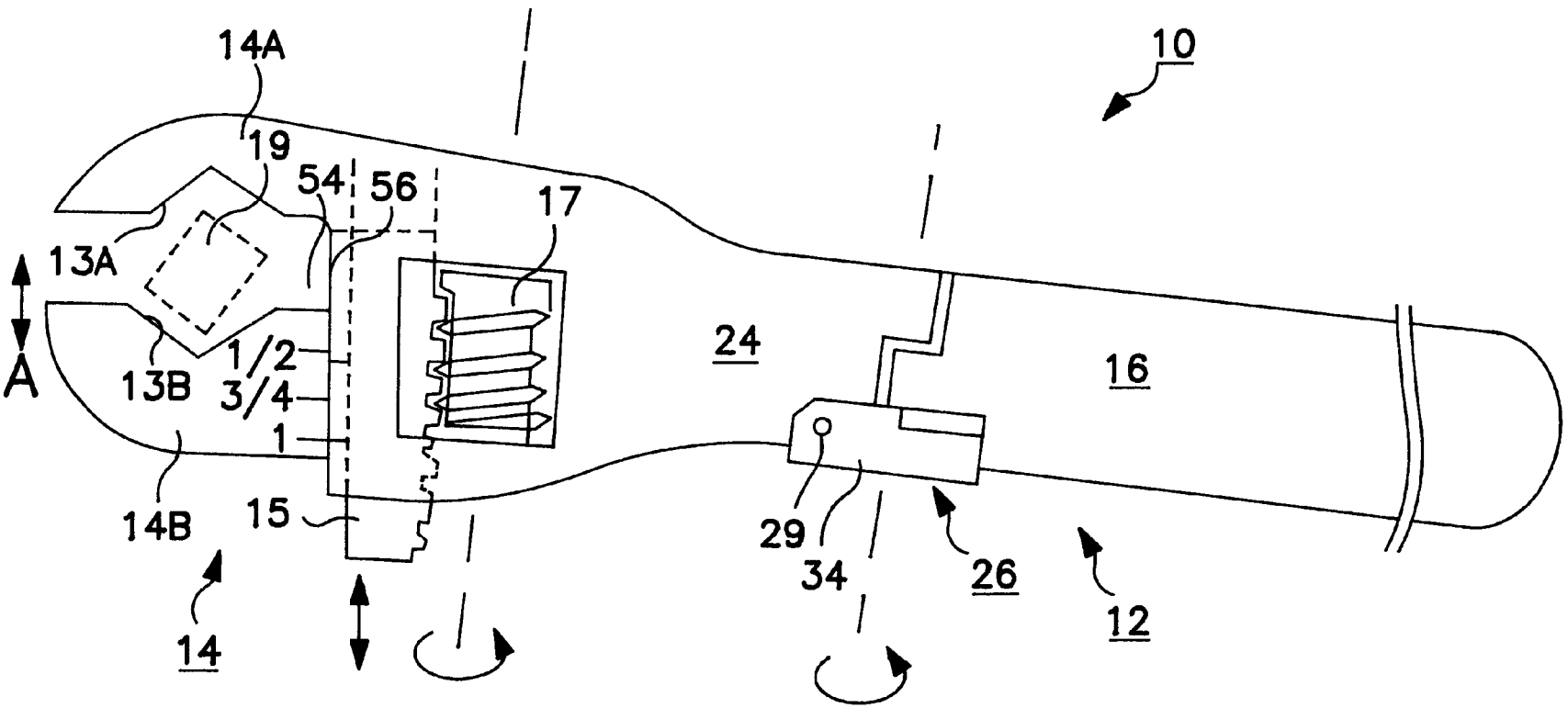
FIG. 1 shows the wrench of this invention.

Turning now to a discussion of the drawings, FIG. 1 shows the adjustable wrench of his invention 10 including a handle 12 attached to a jaw section 14. The jaw section 14 has a fixed jaw 14A that is integrally formed on the end of the handle 12 and a moveable jaw 14B secured to a rack 15 that is slideably mounted in the handle and engages a pinion 17 that is rotatably mounted in the handle 12. Spacing of the gripping surface 13A of the fixed jaw 14A from the gripping surface 13B of moving jaw 14B is accomplished by rotating the pinion 17.

A fastener 19 (shown in phantom) having a square or hexagonal cross section is shown positionable between the gripping surfaces 13A and 13B. In the context of this specification, fastener having a hexagonal or square cross section is to be understood to mean a square or hexagonal nut or a bolt having square or hexagonal head.

Figure 2A:
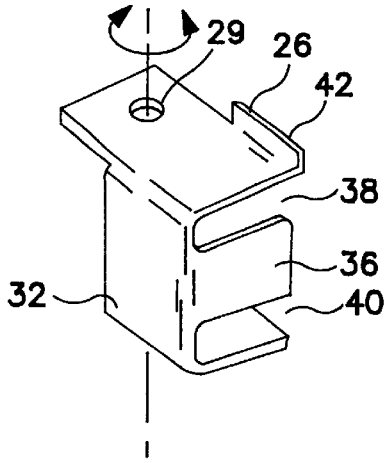
FIG. 2 shows the hinge arrangement of the wrench handle in detail.
Figure 2B:
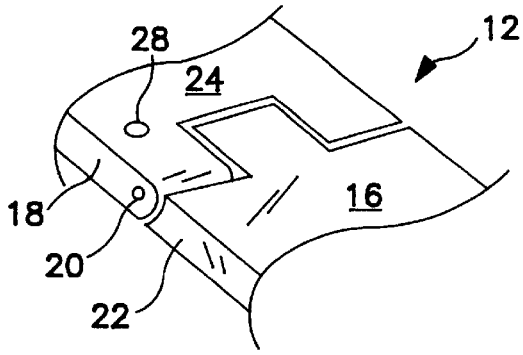

FIG. 1 shows the handle 12 including a first handle section 16, a second handle section 24, and a clip that is shown separate from the handle sections in FIG. 2. The jaw section is cut away in FIG. 4.

FIG. 2 shows a first handle section 16 of the handle 12 with a hinge end 18 joined by a hinging pin 20 to the hinge end 22 of a second section 24 of the handle 12. When assembled as shown in FIG. 1, a clip 26 is rotatably joined to handle section 16 by having panel 34 of clip 26 rotatably pinned by pin 29 to the first handle section 18 at location 28 to swing toward or away from the handle 12. The clip 26 is a (preferably) sheet metal angular bracket with a joining panel 32 joined perpendicularly along one edge to rotating panel 34 and a notch panel 36. Notches 38 and 40 are formed in 36. A thumb panel 42 is shown for turning the clip 26 against or away from the handle 12. The pin hole 29 is shown.

Figure 3:
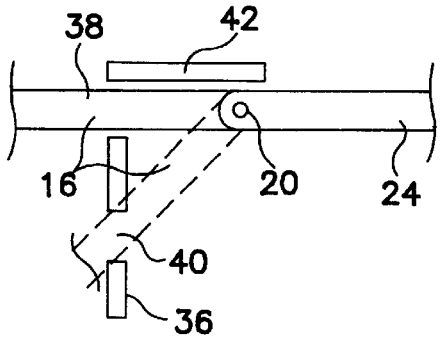
FIG. 3 shows the locking positions of the handle sections.

When the clip 26 is turned away from the handle 12, the handle sections 16 and 24 are free to rotate, about hinge pin 20. FIG. 3 is a side view showing the handle 12 with section 16 parallel to section 24 where it is fixed by engagement of section 24 in slot 38. FIG. 3 also shows (in phantom) the handle 12 with section 16 oriented at an angle to section 24 where it is fixed by engagement of section 24 in slot 38. This feature permits selecting one orientation of the handle sections to permit turning the wrench in a plane that is nearly coincident with the entry surface of the bolt or a second section which permits turning the wrench in a plane that is comfortably displaced from the entry surface of the bolt.

Figure 4:
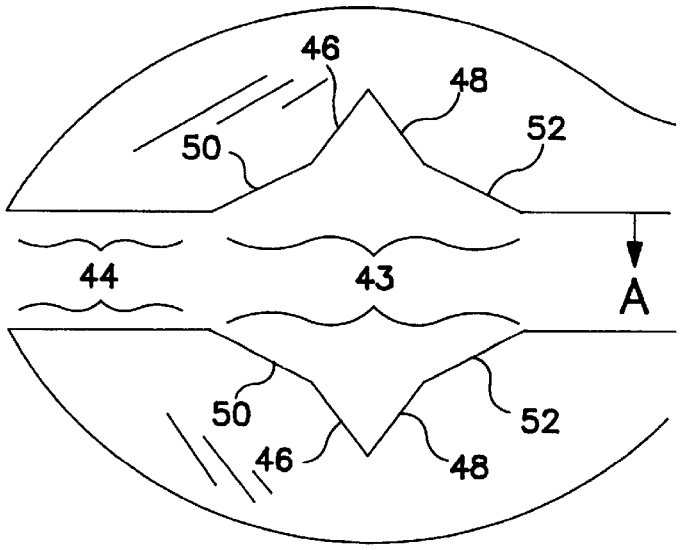
FIG. 4 shows details of the gripping surfaces of the jaws.
Figure 5A:
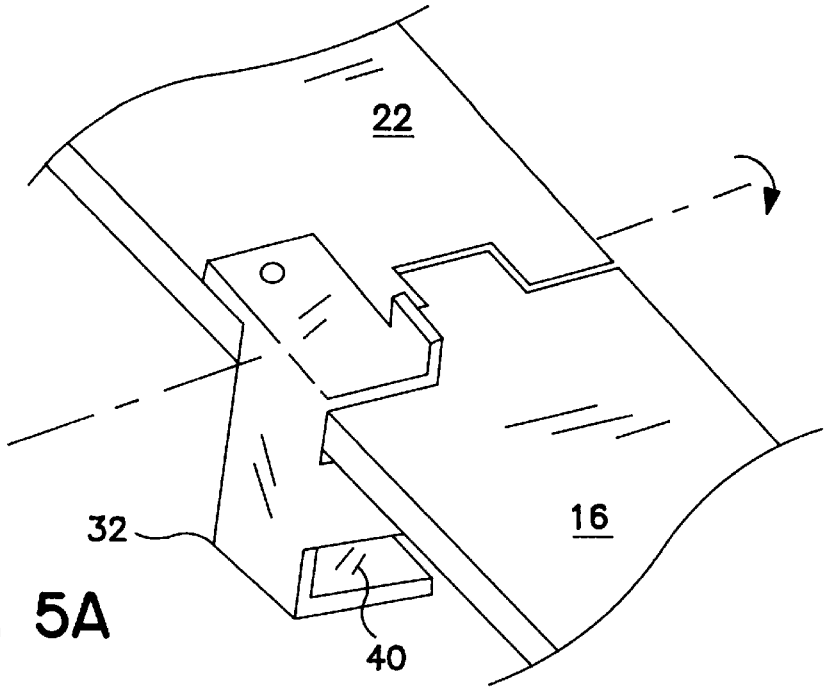
FIG. 5A and 5B shows the two positions of the handle sections.
Figure 5B:
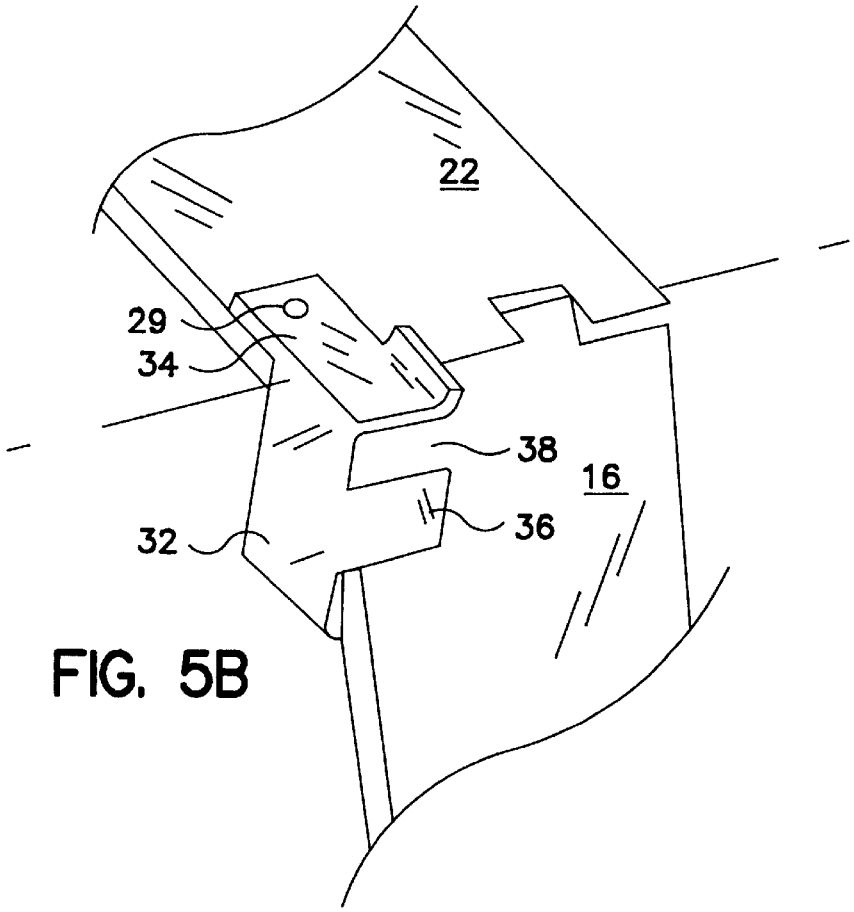

FIG. 4 shows details of the jaw section 14 of this invention to best advantage. The gripping surface of each jaw has a contoured area 42 and a flat area 44. The contoured area has a central portion being two facets 46 and 48 meeting perpendicularly. The contoured surface 42 also has two facets 50 and 52 where facet 50 extends from an edge of facet 46 at an inclined angle of 15° and facet 52 extends from an edge of facet 48 at an inclined angle of 15° and where facet 50 is oriented at an angle of 120° with respect to facet 52. Facets 50 and 52 are inclined at an angle of 60° with respect to the direction of travel of the jaw (arrow A) and facets 46 and 48 are inclined at an angle of 60° with respect to the direction of travel of the jaw (arrow A)

The flat areas 44 of each jaw surface are parallel to one another and perpendicular to the direction of navel of the jaw (arrow A).

The combination of the contoured area 42 and flat area 44 provides that the fastener may first be positioned between flat area 44 for initial quick successive turn and reposition of the wrench while the fastener is loose and then the wrench is positioned with the contoured area gripping the corners of the fastener for finally tightening the fastener. If the fastener is has a square cross section, then facets 46 and 48 grip the surface of the fastener near a corner. If the fastener is hexagonal, then facets 50 and 52 grip the fastener. The broad contact of the contoured surface with the surface of the fastener as opposed to the gripping contact being localized close to a corner of the fastener precludes the possibility of stripping of a corner of the fastener when the fastener is tight.

FIG. 1 also shows markings 54 on one side of the wrench along the meeting line of the movable jaw 14A and the end 56 of the handle 12. Markings (not shown in FIG. 1) are also formed on the opposite side of the jaw. Each mark indicates a setting for attachment of the wrench to a standard fastener. Markings on one side of the jaw indicate the required spacing of the jaws for the contoured surfaces (48–52) of the wrench to grip corners of the fastener. The other side of the wrench indicates required spacing of the flat area of the jaws for positioning the fastener between the jaws for easy turning of the fastener. The feature of indicia indicating spacing is especially useful for work such as under automobiles where adjusting the wrench by "feel" can be very uncomfortable and inconvenient for the mechanic.

There has been presented a description of features of this invention for a wrench which substantially facilitates the job of tightening and loosening bolts and nuts and which satisfy the objects of the invention. Variations and modifications may be suggested by reading the specification and studying the drawings which are within the scope of the invention. For example, the contoured area 42 may be shaped to fit either only a fastener having a square cross section or a hexagonal cross section. I therefore wish to define the scope of my invention by the appended claims.

I claim:

1. A wrench which comprises:

a handler;

a pair of jaws mounted on one end of said handle;

a fixed one of said pair of jaws being integral with said one end and a moveable one of said jaws is mounted on said one end in operable combination with said fixed jaw to permit gripping a fastener positioned between said pair of jaws;

said fixed jaw and said moveable jaw each having a gripping surface;

said gripping surface of said fixed jaw and said gripping surface of said moveable jaw facing one another to permit gripping a fastener positioned between said gripping surfaces;

means for moving said moveable jaw relative to said fixed jaw to provide a spacing between said gripping surfaces required for positioning a fastener between said gripping surfaces;

said gripping surface of each jaw having a contoured area 42 and flat area (44);

said contoured area 43 having a central portion being a first pair of facets (46,48) meeting perpendicularly;

said contoured area (43) having a second pair of facets (50, 52), one of said second pair of facets being on one side of said first pair of facets and another one of said second pair of facets being on an opposite side of said first pair of facets;

one facet (50) of said second pair of facets extending from an edge of one facet (46) of said first pair of facets at an inclined angle of 15° and another facet (52) of said second pair of facets extending from an edge of another facet (48) of said first pair of facets at an inclined angle of 15° and wherein said one facet (50) of said second pair of facets is oriented at an angle of 120° with respect to said another facet (52) of said second pair of facets;

each of said second pair of facets (50, 52) being inclined at an angle of 60° with respect to direction of travel of said moveable jaw (14B);

said surfaces of said jaws operably arranged to permit a fastener having a square cross section be positioned between said jaws with said first pair of facets of said fixed jaw positioned against one pair of sides of said fastener having a square cross section and with said first pair of facets of said moveable jaw positioned against an opposite pair of sides of said fastener having a square cross section; and said surfaces of said jaws operably arranged to permit a fastener having a hexagonal cross section be positioned between said jaws with said second pair of facets of said fixed jaw positioned against one pair of sides of said fastener having a hexagonal cross section and with said second pair of facets of said moveable jaw positioned against an opposite pair of sides of said fastener having a hexagonal cross section; and said flat area (44) of each jaw surface being parallel to one another and perpendicular to the direction of travel of movable jaw (14) providing that a fastener having a cross section with parallel sides is positionable between said flat areas of said gripping surface with one side of said fastener against said flat area of said fixed jaw and an opposite side of said fastener against said flat area of said movable jaw.

2. The wrench of claim 1 which comprises:

said fixed jaw having an array of markings and said moveable jaw having an array of markings operably arranged to provide that each setting of a series of settings of markings on said movable jaw with respect to said markings on said fixed jaw corresponds to a required spacing of said jaws from one another for turning one of a series of standard fastener sizes.

3. The wrench of claim 1 wherein said markings on said movable jaw and said markings on said fixed jaw are arranged along an edge of said moving jaw meeting an edge of said fixed jaw.

4. The wrench of claim 1 wherein said means for moving comprises:

a rack (15) secured to said movable jaw (14B) and slideably mounted in an end of said handle;

a pinion (17) rotatably mounted in said handle (12) and engaging said rack operably arranged to permit spacing of the gripping surface of the fixed jaw 14A from the gripping surface of moving jaw 14B by rotating the pinion 17.

5. The wrench of claim 1 which comprises:

said handle includes one handle section having one end hingeably secured to one end of another handle section to rotate about an axis of rotation;

a clip having a plurality of notches;

said clip being rotatably mounted on said one end of said one handle section in operable combination with said another handle section to provide that, when said clip is rotated in a first position, said one handle section is freely rotatable with respect to said another handle section and when said clip is rotated in a second position with said another one of said one and another handle section engaged with a selected one of said plurality of notches, then orientation of said one handlesection is fixed relative to said another handle section.

* * * * *